United States Patent [19]

Madeley

[11] Patent Number: 4,701,136

[45] Date of Patent: Oct. 20, 1987

[54] ELECTRICAL CONNECTOR COMPONENT

[75] Inventor: John N. Madeley, Worksop, England

[73] Assignee: TRW Inc., Redondo Beach, Calif.

[21] Appl. No.: 820,056

[22] Filed: Jan. 21, 1986

[30] Foreign Application Priority Data

Feb. 15, 1985 [GB] United Kingdom ..... 8503880

[51] Int. Cl.[4] ..... H01R 11/20

[52] U.S. Cl. ..... 439/76; 439/404

[58] Field of Search ..... 339/17 R, 17 C, 17 F, 339/97 R, 97 P, 98, 99 R, 176 MF

[56] References Cited

U.S. PATENT DOCUMENTS 3,737,833 6/1973 Jerominek ..... 339/17 F
3,961,834 6/1976 Venaleck et al. ..... 339/176 M
4,286,835 9/1981 Adams et al. ..... 339/99 R
4,458,970 7/1984 Fourreau et al. ..... 339/99 R
4,579,404 4/1986 Lockard ..... 339/176 MF

FOREIGN PATENT DOCUMENTS 1180028 2/1970 United Kingdom ..... 339/17 F

*Primary Examiner*—Neil Abrams
*Attorney, Agent, or Firm*—Sol L. Goldstein

[57] ABSTRACT

An electrical connector component comprising a first array of discrete connector component-engaging contactors and a second array of discrete cable-engaging terminals, wherein the arrays are electrically interconnected by means of a printed circuit board for electrically interconnecting the arrays of contactors and cable-engaging terminals providing electrical pathways between selected contactors and terminals in the respective arrays.

11 Claims, 13 Drawing Figures

FIG. 1
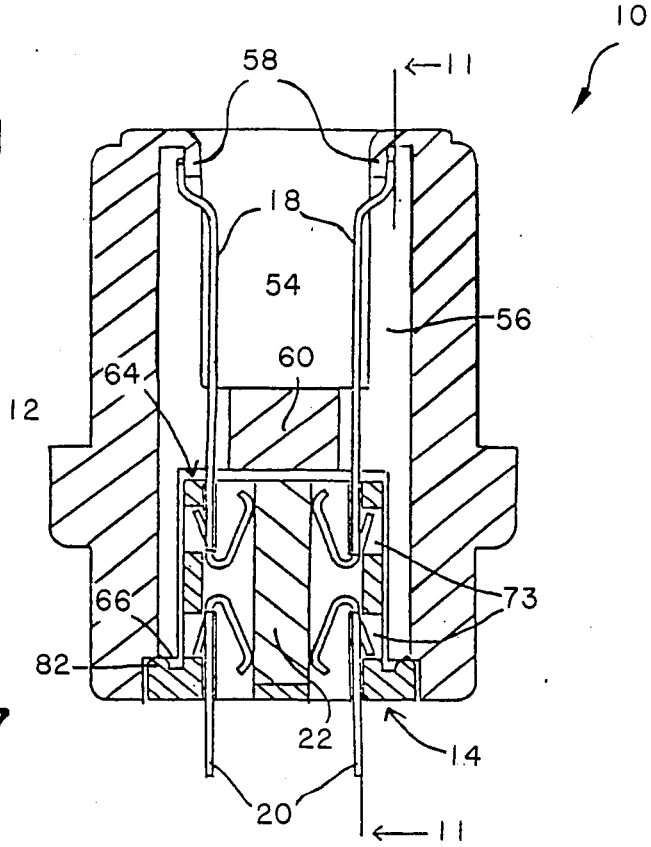
FIG. 6
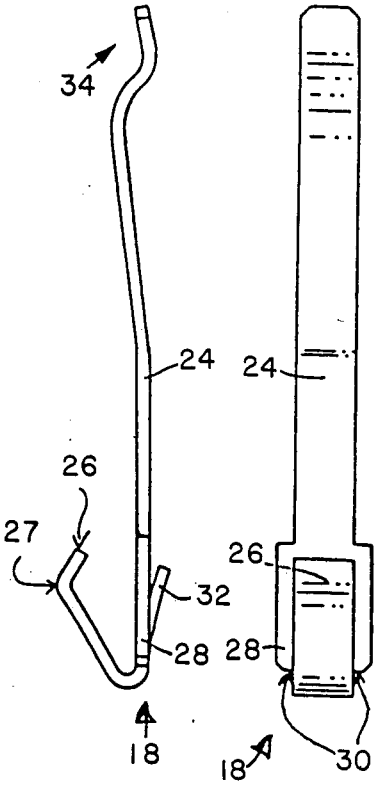
FIG. 7
FIG. 8
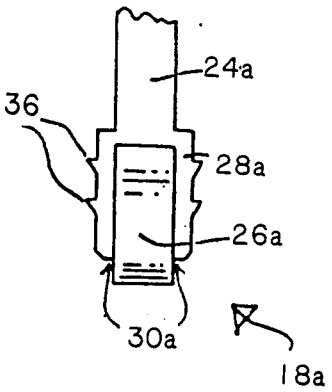

FIG. 9
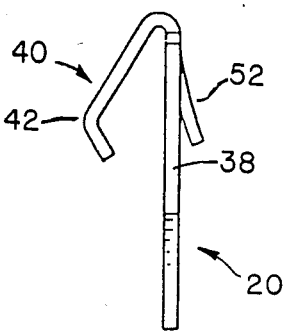
FIG. 10
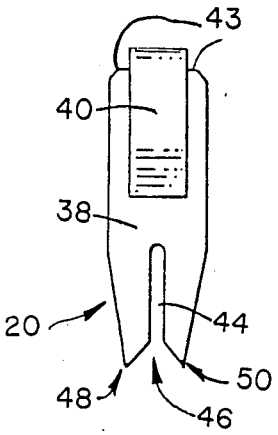
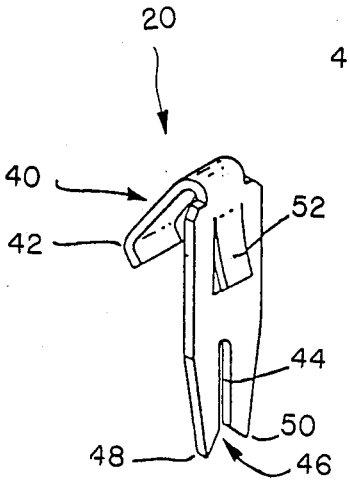
FIG. 11
FIG. 12
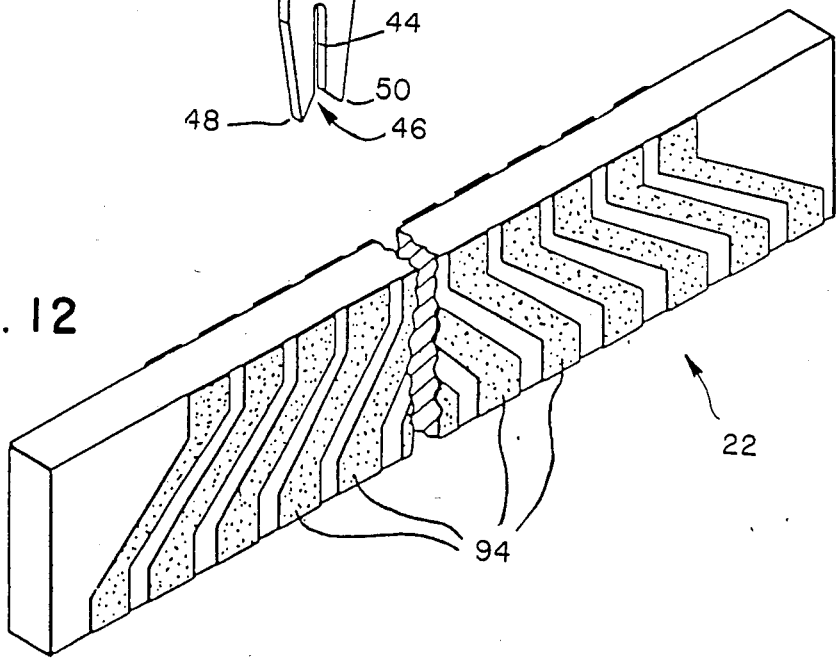

ELECTRICAL CONNECTOR COMPONENT

The present invention relates to an electrical connector component which may be a plug or a socket member and which is configured for engagement with another, complementarily shaped, connector component and concerns particularly, but not exclusively, a connector component comprising a plurality of ribbon-like contact elements, commonly known as a ribbon connector component. The word "ribbon" in this context refers to the contact elements in the connector component being formed from metal strips.

Known connector components of this type comprise an array of contact elements arranged in two generally parallel rows. At one end of the connector component the contact elements have portions, herein referred to as contactor portions, which are arranged for co-operation with a corresponding array of contact elements on a plug or socket, as appropriate, with which the connector component is adapted to engage. At the other end of the connector component the contact elements have portions, herein referred to as terminal portions, which terminate in flat tabs having a conductor-receiving slot disposed between two barbed portions. This enables a flat insulated cable to be electrically connected to the connector component merely by forcing the barbed portions into the flat cable so that the individual conductors within the cable each make contact with each edge of the slot in one of the terminal portions, a method commonly termed "insulation displacement".

The terminal portions of the contact elements are preferably made from resilient beryllium copper of a suitable thickness and in practice this means that the whole of the contact element will usually be made of this material and thickness. It is desirable to apply a gold plating to the contactor portions to ensure good conductivity and to prevent corrosion and a cheaper plating material, for example a tin/lead alloy, is suitable for the terminal portions. Usually, either the contact elements are entirely gold plated or gold plating is applied to the contactor portions by head immersion and a different plating is then applied to the terminal portions by tail immersion.

In connecting an electrical connector component to a flat cable, a problem arises in that different constraints apply regarding the pitch of the contactor portions for these to conform to the standards of connector manufacturers, and regarding the pitch of the terminal portions for these to conform to the standard spacing between the strands in flat cable. For the purposes of this specification, the term "pitch" is the distance, as viewed along a row of contact elements, between the centre lines of adjacent contact elements in a row.

In electrical connectors of the ribbon type, a common convention is for the pitch of the contactor portions to be 0.085 inches (2.16 mm) to comply with the pitch of contacts as manufactured by ribbon connector manufacturers. The common convention for the spacing of strands in flat cable is 0.050 inches (1.27 mm) which is the distance between the centres of the conductive strands in the cable. It is usual to form the contact elements so that the contactor portions are arranged in two parallel rows with the portions in one row aligned with opposing portions in the other row and the pitch of the portions in each row being 0.085 inches (2.16 mm). The terminal portions are differently arranged in two generally parallel rows, the portions in each row having a pitch of 0.1 inches (2.54 mm) and with the portions in one row being offset from the portions in the other row thereby providing an effective spacing of 0.050 inches (1.27 mm) between pairs of closest terminal portions. The terminal portions are normally arranged in this way to provide each portion with a certain minimum size to be the correct shape and to have the structural strength required for it to be able to form its insulation displacement function. To meet these requirements and also to conform to the required pitch the terminal portions are arranged in two rows in staggered formation.

It is usual to use flat cable containing a number of conductors corresponding to the number of contacts in the usual range of ribbon connectors, for instance 14, 24, 36, 50 or 64. Owing to the difference in pitch needed at opposite ends of the connector component, it is common to form the contact elements in bent form with each having a central portion which is inclined so that the contactor and terminal portions of the contact element can be axially offset. The degree of axial offsetting varies along the rows with the outermost contact elements needing to be the most bent.

In practice, it is known to punch a comb of contact elements of differing degrees of bending using a specially designed tool. This, however, has several disadvantages. If one of the contact elements in the comb is damaged, the entire comb is useless and must be wasted. The required tool is relatively complex and therefore costly. Furthermore, a different comb tool is required depending on the number of connector ways, e.g. 14, 24, 36, 50 or 64.

Another approach has been to manufacture individual contact elements bent by differing amounts. This has the advantage of reducing wastage but requires a greater number of complex tools and is therefore even more costly.

The blanked metal combs or individual bent contact elements are then "insert" moulded so that they are permanently surrounded by moulding material. This has the disadvantage that the assembly time is lengthened by the relatively slow moulding operation and the whole "insert" moulded assembly has to be wasted if a single contact element in the comb is damaged.

The present invention aims to overcome the above problems.

According to the present invention we provide an electrical connector component comprising a first array of discrete connector component-engaging contactors and a second array of discrete cable-engaging terminals, wherein the arrays are electrically interconnected by means of a conductive member providing electrical pathways between selected contactors and terminals in the respective arrays.

The present invention has a number of very important advantages. The manufacture and tooling of an electrical connector component according to the present invention is greatly simplified by several factors which stem from the use of two separate arrays of discrete terminals and contactors and a conductive member for electrically connecting the two arrays. The contactors and terminals within each array can all be of the same shape. This applies for any number of connector ways thereby obviating the need for different tools for each size of connector. The contactors and terminals in the two arrays can also be subjected to different treatment during manufacture and different materials and different material thicknesses can be used for the contactors and terminals in each array. Additionally, if one or more of the contactors or terminals become damaged after assembly, they can be individually replaced.

In an electrical connector component according to the present invention, the contactors and terminals can all be of simple shape, for example, blades which are straight in one dimension, and are therefore relatively simple and cheap to produce. This feature also facilitates assembly of the connector component and enables the use of automatic assembly processes. For example, tools can be used which produce arrays of similar contactors or terminals on carrier strips. Damage to an individual contactor or terminal does not affect the other contactor or terminals being produced and wastage is reduced in comparison with the known procedure which involves the production of combs of contacts.

Furthermore, there is no need to insert mould the arrays of contactors and terminals because these can easily be assembled, preferably automatically, in a connector housing owing to their all having the same shape. Assembly speed is thus increased. Moreover, since the contactors and terminals in each array are all the same shape, their number and spacing can be varied to suit requirements.

The present invention enables different plating finishes to be applied to the contactors and terminals. For example, instead of gold plating the complete contact element as formerly, the contactors can be selectively gold plated and the terminals can be electro-plated with a tin/lead alloy thus reducing the material costs. Furthermore, the terminals may be made from relatively thick resilient beryllium copper, which is a relatively expensive material, and the contactors may be made from thinner and cheaper material, for example, phosphor bronze or brass. This permits substantial cost savings.

The conductive member for electrically interconnecting the arrays of contactors and terminals may be generally flat and the electrical pathways may be formed on one or both faces thereof. Different circuit layouts may be introduced to suit particular functional requirements, for instance the paths may be bridged or linked together. In a particular embodiment, the conductive member comprises a printed circuit board. Alternatively, the conductive member may be in the form of a printed flexible sheet, for example, the type known as "flexi-circuit".

In a particular embodiment, two opposed faces of the conductive member for electrically connecting the arrays of contactors and terminals are each sandwiched between pairs of rows of contactors and terminals which preferably form a high pressure fit against the electrical pathways on the conductive member to provide secure electrical and mechanical interconnection.

A preferred embodiment of the present invention will now be described, by way of example, with reference to the accompanying drawings in which:

FIG. 1 is a cross-sectional end view of a connector component according to the present invention;

FIGS. 6 and 7 are a side view and a front view respectively of one of the contactors of the electrical connector components shown in FIGS. 1-5;

FIG. 8 is a partial front view of a modified form of contactor;

FIGS. 9-11 are a side view, a front view and a perspective view respectively of one of the terminals of the connector components shown in FIGS. 1-5;

FIG. 12 is a perspective view of the printed circuit board of the connector components shown in FIGS. 1-5;

Figure 2:
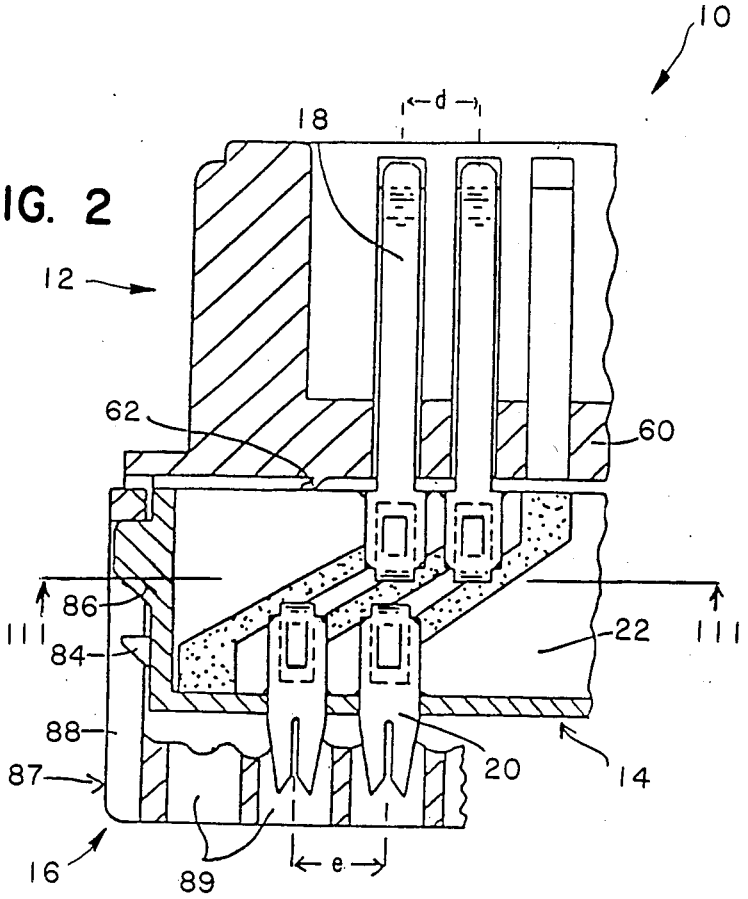
FIG. 2 is a partial cross-section on view taken along lines II—II of FIG. 1.
Figure 3:
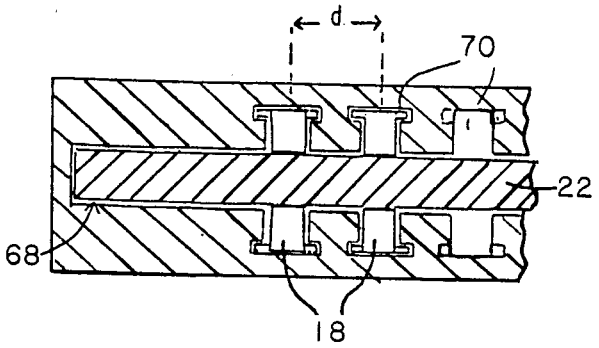
FIG. 3 is a partial view taken in cross-section along the lines III—III in FIG. 2.

Referring to FIGS. 1-3, an electrical connector component indicated generally at 10 is a socket member comprising an outer housing 12 and an inner housing 14, both formed from moulded plastics material. A cable retaining cover 16 is illustrated in FIG. 2. The part 10 comprises contactors indicated generally at 18 and arranged at pitch d and terminals indicated generally at 20 and arranged at pitch e. Typical values for the pitches d and e are 0.085 inches (2.16 mm) and 0.1 inches (2.54 mm) respectively. It should be understood that only a relatively small portion of the length of the component 10 is shown in FIGS. 2 and 3 and, in a 36 way connector component the component 10 would be of a length able to accommodate 36 each of the contactors 18 and the terminals 20. This type of connector component may have a different number of ways, typically 14, 24, 36, 50 or 64 in which case it will contain a corresponding number of contacts.

A printed circuit board 22 for electrically connecting the contactors 18 and terminals 20 is held in the inner housing 14 sandwiched between pairs of the contactors 18 and the terminals 20.

Referring now to FIGS. 6 and 7, each of the contactors 18 may be formed from phospor bronze and may be selectively gold plated. In practice, each contactor 18 may have a thickness less than the thickness of the terminals 20. Each contactor 18 comprises an elongate flat body 24 which is bent at its lower end to form a resilient tongue 26 defining a curved contact portion 27. In the region of the tongue 26, the contactor 18 has a relatively wide portion 28 which, where the tongue 26 joins the body 24, defines two aligned shoulders 30. A resilient finger 32 is formed from the material of the widened portion 28 and this projects outwardly from the body 24 as seen in FIG. 6. The upper half of the body 24 is slightly inclined relative to the lower half and the upper end 34 of the body 24 is cranked and is adapted to cooperate with a formation on the outer housing 12 to be described later.

Figure 5:
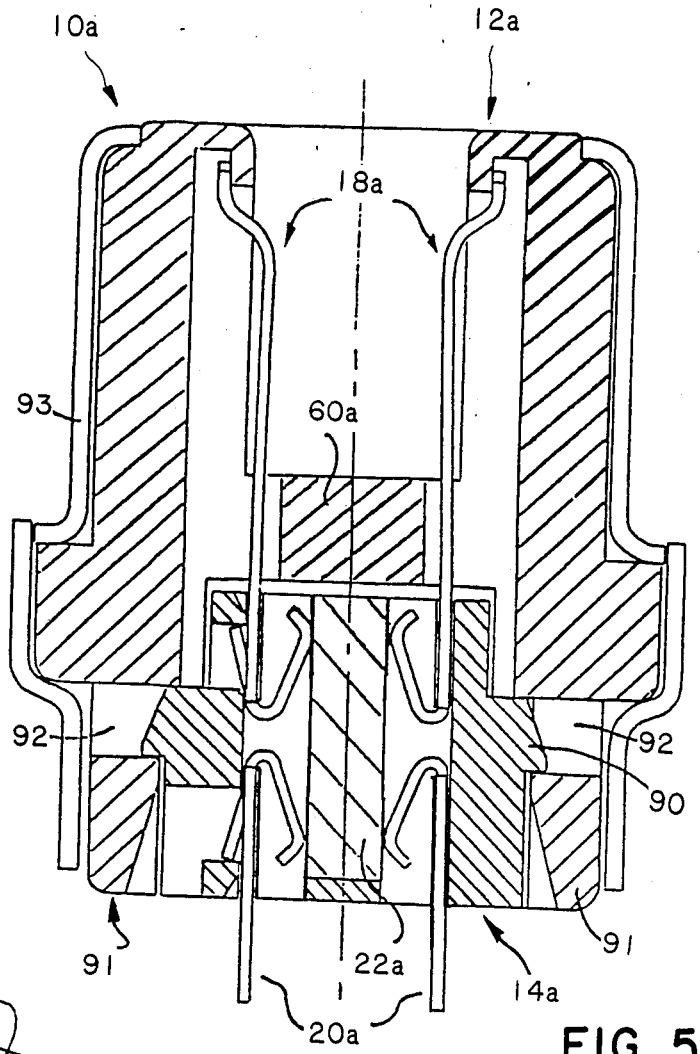
FIG. 5 is a cross-sectional end view of a modified form of connector component.
Figure 4:
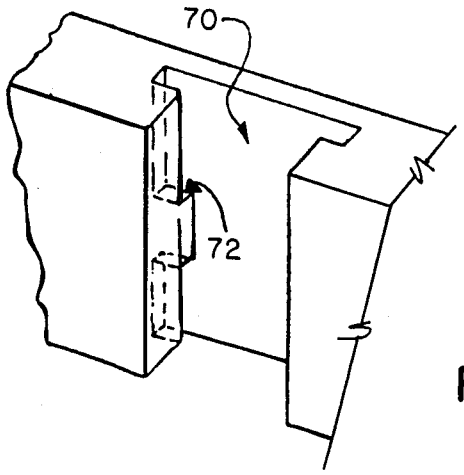
FIG. 4 is a schematic view of a part of the connector commponet of FIGS. 1-3.

Referring to FIG. 8, the same reference numerals but bearing the suffix "a" have been used as were used with reference to FIGS. 4 and 5. The only difference in the modified contactor **18*a* is that, instead of a finger 32, one or more barbs 36 are formed on each side of a widened portion 30 which serve as means for retaining the contactor 18*a* in the inner housing 14**.

Referring to FIGS. 9-11, each of the terminals 20 is made from beryllium copper and may be electro-plated with tin containing a small proportion of lead. In practice, each terminal 20 may have a thickness greater than the thickness of the contactors 18. Each of the terminals 20 comprises a flat body 38 which is bent at its upper end to form a resilient tongue 40 defining an arcuate contact portion 42. The tongue 40 is of smaller width than the adjacent part of the body 38 so that two aligned shoulders 43 are defined where the tongue 40 joins the body 38. The lower end of the body 38 converges slightly and is formed with a slot 44 in communication with a notch 46 between two pointed extremities 48 and 50 of the body 38. A resilient finger 52 is formed from the material of the body 38 and this projects outwardly from the body 38.

Returning to FIGS. 1–3, the outer housing 12 defines a socket 54 for receiving a plug member (not shown) and has a series of pairs of opposed slots 56, each slot 56 defining a ledge 58 for retaining the cranked end 34 of a contactor 18. The parts of the body 24 of each of the contactors 18 which are exposed in the socket 54 mate with rows of contact members provided on the plug member. The outer housing 12 comprises a center piece 60 formed with a resilient depending lug 62 which serves to deter upward movement of the printed circuit board 22. The lower part of the outer housing 12 is formed with a channel 64 for receiving the inner housing 14. The channel 64 widens to form two aligned shoulders 66, one on each side of the inner housing 14.

The inner housing 14 comprises a slot 68 for receiving the printed circuit board 22, two rows of aligned T-shaped slots 70 for receiving the contactors 18. Referring to FIG. 4, in each side of each slot 70 is a ledge 72 which forms a stop for the shoulders 30 and 43 of the respective contactors 18. Each of the slots 70 communicates with a recess 73 formed through a wall of the inner housing 14. The lowermost part of the inner housing 14 comprises two rows of similar but offset T-shaped slots (not shown) for receiving the terminals 20.

The inner housing 14 has a widened lower portion 80 provided with a series of upstanding, pointed, pips 82 (shown in FIG. 1) along each side thereof which co-operate with the outer housing 12 as will be explained. As seen from FIG. 2, two ramps 84 and 86 are provided on the side of the inner housing 14. The ramp 84 is relatively small and lies underneath and offset relative to the larger ramp 86. The ramp 86 is not shown in FIG. 3.

The cover 16 has a generally flat base 87 and has an upstanding wall 88 at each end thereof. The wall 88 is provided with two recesses shaped and positioned to co-operate with the ramps 84 and 86 on the inner housing 14. The base 87 has an undulating top surface and is provided with a plurality of slots 89 for receiving the lower ends of the terminals 20 when the cover 16 is in a closed position as shown in FIG. 2.

The cover 16 can occupy two alternative positions relative to the inner housing 14 namely, a partially open position and a closed position. The cover 16 is in the partially open position when the ramp 84 on the inner housing 14 is engaged in an aperture (not shown) near the top of the end wall 88. In the partially open position, there is a gap between the base 87 and the bottom of the inner housing 14 for receiving a flat cable therebetween. The cover 16 occupies the closed position when the ramp 86 on the inner housing 14 is located in a recess provided at the top of the end wall 88 as shown in FIG. 2.

Referring to FIG. 5, the same reference numerals and bearing the suffix "a" have been used as were used with reference to FIGS. 1–4. The main difference in the modified connector component 10*a* is in the configuration of the outer housing 12*a* and the inner housing 14*a*. The inner housing 14 is provided on each side with a ramp member 90 configured to co-operate with a tapered lead-in portion 91 provided at the lowermost part of the outer housing 12*a* and to snap-engage behind the lead-in portion 91 into a recess 92 in the outer housing 12*a*. The component 10*a* as shown in FIG. 5 additionally comprises an outer metal shell 93 for reducing radio frequency interference or electro-magnetic induction effects during use.

Figure 13:
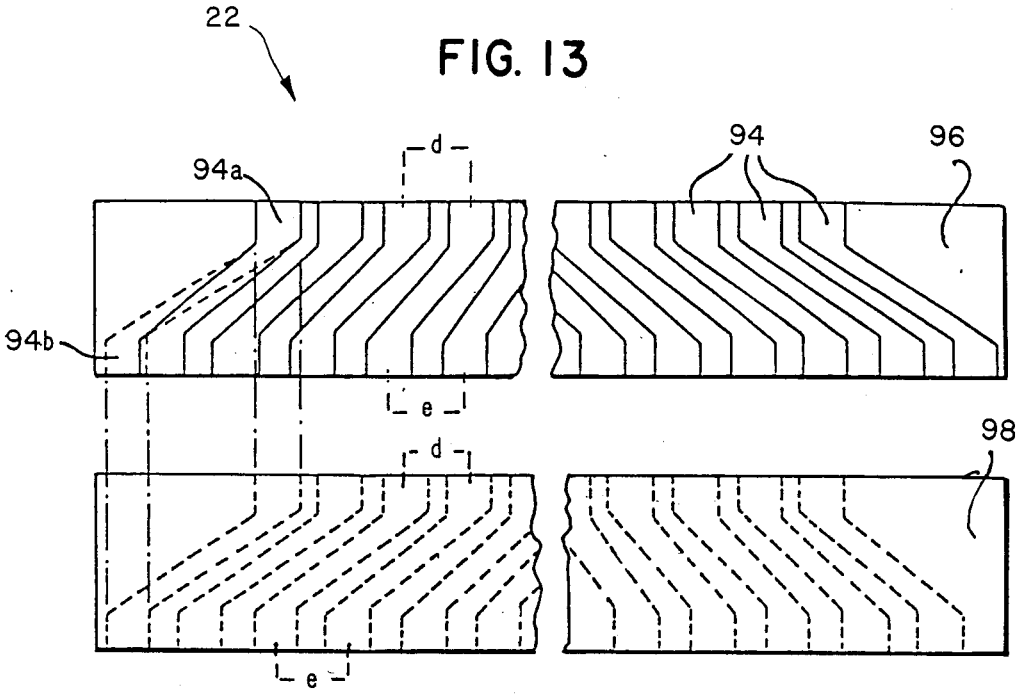
FIG. 13 is a schematic view illustrating the relative positions of the electrically conductive paths on the two faces of the printed circuit board shown in FIG. 12.

Referring to FIGS. 12 and 13, the printed circuit board 22 comprises a plurality of conductive copper paths 94 and may be made of standard synthetic resin bonded paper or, if better quality is required, may be made from high grade fibreglass/epoxy resin material. Each of the conductive paths 94 is bent and the degree of bending reduces towards the middle of the length of the board 22. The middle portion of the board 22 is not shown but includes at its very centre paths 94 which are straight or almost straight. The pitch of the upper ends of the conductive paths 94 corresponds to the pitch d of the contactors 18. The pitch of the lower ends of the conductive paths 94 corresponds to the pitch e of the terminals 20. FIG. 13 illustrates both sides 96 and 98 of the printed circuit board 22 and shows that the conductive paths 94 on the two sides 96 and 98 are not exactly aligned. By way of explanation, on the lefthand side of the side 94, a conductive path 94*a* is shown and the corresponding conductive path 94*b* on the other side 96 of the board 22 is illustrated in dotted lines. It can be seen that the upper ends of the conductive paths 94*a* and 94*b* are aligned but that the conductive path 94*b* is more bent than the path 94*a* so that the lower ends of the paths 94*a* and 94*b* are out of alignment. This is because the upper ends of the conductive paths 94 on the board 22 are positioned to mate with the two rows of aligned contactors 18 and the lower ends of the conductive paths 94 on the board 22 are positioned to mate with the two rows of offset terminals 20. However, for other applications, a printed circuit board in which the conductive paths on each face are aligned may be used.

The connector component 10 described above is assembled by first placing the printed circuit board 22 in the slot 68 of the inner housing 14. In practice, lugs may be provided in the slot 68 for engagement in recesses in the printed circuit board 22 to eliminate lengthwise movement of the printed circuit board 22 in the slot 68. The contactors 18 are then inserted into the T-slots 70. The ledges 72 prevent over insertion. During insertion, the fingers 32 are aligned with the body portion 24 but, when these reach the slot 73, they spring outwardly from the body 24 so as to hinder subsequent removal of the contactor 18. If it is desired to remove one or more of the contactors 18, for example, if one of the contactors 18 should become damaged, this can be achieved by inserting a tool into the appropriate slot 73 in the inner housing 14 so as to depress the finger 32 into the body 24 so that the contactor 18 can be removed. In the case of the modified form of contactor 18*a* shown in FIG. 6, the contactor 18*a* is simply pushed into a T-slot 70 causing the barbs 36 to bite into the side walls of the slot 70 and thereafter to resist removal of the contactor 18*a*.

The electrical paths 94 on the printed circuit board 22 are arranged so that the curved contact portions 27 of the tongues 26 each contact one of the electrical paths 94. The tongues 26 are a tight frictional fit with the paths 94 which ensures a good electrical connection and also serves to hold the printed circuit board 22 firmly in place. If desired, manual soldering or vapour-phase methods can be used to secure the contactors 18 to the printed circuit board 22 but these steps are not normally necessary.

The terminals 20 are inserted into the stagger rows of T-slots similar to slots 70 and provided in the lowermost part of the inner housing 14 in an exactly similar way as just described with respect to the contactors 18. The conductive paths 94 on the printed circuit board 22 are arranged so that the curved contact portion 42 on the tongue 40 of each of the terminals 20 makes contact with one of the paths 94.

The inner housing 14 carrying the printed circuit board 22, the contactors 18 and the terminals 20 is then inserted into the recess 64 in the outer housing 12. A tool is used to guide the cranked ends 34 of the contactors 18 into the slots 56 and into engagement with the ledges 58 so as to be positioned as shown in FIG. 1. The pips 82 on the inner housing 14 abut the ledges 66 of the outer housing 12. Ultrasonic welding is then carried out and this causes the material in the pips 82 to flow and weld with the material of the ledges 66 thereby to secure the inner housing 14 in the outer housing 12. Additionally, the outer housing 12 could then be encased in a metal shell (not shown) so as to reduce radio frequency interference or electro-magnetic induction effects during use.

In the case of the embodiment shown in FIG. 5, the ultrasonic welding step is not needed as, when the inner housing 14*a* is slidably inserted into the outer housing 12*a*, the ramp members 90 snap-engage behind the tapered lead-in portion 91 when they reach the recesses 92 in the outer housing 12*a*. The ramp members 90 then abut the upper face of the lead-in portion 91 so as to retain the inner housing 14*a* in the outer housing 12*a*.

Preferably, the connector component 10 is assembled using an automatic assembly process. In this case, the contactors 18 and the terminals 20 are each produced on carrier strips which are then reeled. After the necessary plating steps have been carried out the required number of contactors 18 and terminals 20 may be simultaneously inserted into the inner housing 14 which already contains the printed circuit board 22.

If, during assembly or when in use, one or more of the contactors 18 or terminals 20 are damaged, these may be individually replaced by inserting a tool in the recesses 73 to depress the resilient finger 32 or 52 as appropriate, removing the damaged element and slidably inserting a new element.

In use, the connector component 10 is attached to a flat cable (not shown) by first clipping the cover 16 into the partially open position. This is done by positioning the cover 16 so that the base 87 underlies the terminals 20 and the side walls 88 engage the ends of the inner housing 14. The cover 16 is then pressed onto the inner housing 14 so that the smaller ramp 84 engages in a recess in the end wall 88 of the cover 16 so as to hold the cover 16 in the partially open position. The cable is then inserted into the gap between the base 87 of the cover 16 and the inner housing 14 so as to rest on the base 87 underlying the terminals 20. The cover 16 is then pressed further onto the inner housing 14 causing the end walls 88 to slide relative to each end of the inner housing 14 and causing the end wall 88 to ride up over the ramp 84 and the ramp 86 until the ramp 86 latches into a larger slot in the end wall 88. Movement of the cover 16 from the partially open position to the closed position causes the two pointed extremities 48 and 50 on each of the terminals 20 to pierce the insulation of the cable and to enter one of the slots 89 so that the slot 44 embraces an individual conductor within the cable so that the conductor makes contact with each edge of the slot 44. In this way, each of the terminals 20 is electrically connected to one of the individual conductors within the flat cable. Adjacent ones of the individual conductors in the cable are positioned in slots in nearest neighbouring offset ones of the terminals 20.

The socket member 10 is configured to receive a complementary plug member as a push fit in the socket 54 to complete an electrical line.

It will be apparent that a connector component according to the present invention is simple to manufacture by reason of the contactors and terminals all being of simple shape and also because only two different contact portion shapes are required. The ability to use different materials and thicknesses for the contactors and terminals and to plate these in different ways enables substantial cost savings to be made.

If desired, one or more rows of contactors and/or terminals can be employed. The contactors and terminals need not necessarily correspond in one-to-one relationship but many variations are envisaged according to requirements and the conductive paths on the printed circuit board need simply be configured accordingly. For example, a contactor can be electrically connected to two or more terminals by bridging the conductive paths on the printed circuit board appropriately. Alternatively or as well, a contactor can be electrically connected to the terminal other than one of the nearest terminals by cross-linking the conductive paths on the printed circuit board. Connection of a contactor and terminal in different rows can also be achieved by through-linking the conductive paths on the printed circuit board i.e. by leading the path through the thickness of the printed circuit board.

If desired, electrical components such as capacitors and resistors can be incorporated in the printed circuit.

Instead of using a printed circuit board, a flexible film comprising conductive paths of copper, known as a flexi-circuit, can be used. In this case, a support is provided in the inner housing of the connector part around which the film can be wrapped and secured. If a circular arrangement of contact portions is required, a circular support can be used. If two arrays of contact portions each consisting of two concentric circles need to be connected, an annular support for a flexi-circuit may be provided.

I claim:

1. An electrical multiple-way connector component adapted to receive a circuit board comprising:

a first array of connector component-engaging contactors disposed in parallel relation to one another and arranged at a first pitch;

a second array of discrete cable engaging terminals disposed in parallel relationship to one another for engaging wire-type conductors of a flexible cable and arranged at a second pitch, said first and second pitches being of a different dimension from each other and the contactors of said first array being offset from the terminals of said second array;

housing means formed with slot means therein, said slot means for removably retaining said contactors and said terminals in said connector component;

circuit board means removably assembled to both said arrays and providing on at least one surface thereof spaced conductive electrical pathways for electrically interconnecting the array of contactors at one pitch with the array of terminals at a different pitch, the array of said terminals being arranged to electrically engage portions of said wire-type conductors of said flexible cable that extend substantially perpendicular to the plane of the circuit board means; and said housing means receiving said circuit board means whereby a reduced length of conductive paths is provided between said arrays.

2. A component according to claim 1 wherein the conductive member is generally flat and the pathways are formed on one face thereof.

3. A component according to claim 2 wherein the pathways are formed on two opposite faces of the member.

4. A component according to claim 1 wherein the circuit board means comprises a printed circuit board.

5. A component according to claim 1 wherein at least one of the first and second arrays is arranged in two generally parallel rows.

6. A component according to claim 5 wherein both of the arrays are arranged in two generally parallel rows.

7. A component according to claim 6 wherein, in the first array, the contactors in one row are aligned with the contactors in the other row and, in the second array the terminals in one row are offset relative to the terminals in the other row.

8. A component according to claim 1 wherein an edge of the circuit board means is sandwiched between the two rows of the opposing arrays.

9. A component according to claim 7 wherein each contactor and terminal is elongate and is formed with a resilient tongue for engaging the circuit board means so as to contact an electrical pathway.

10. A component according to claim 1 wherein the housing comprises two interengageable housing sections defining a recess for the circuit board means and comprising means for mounting the contactors and terminals adjacent the electrical pathways of the circuit board means.

11. A component according to claim 10 configured so that the contactors and terminals make high pressure contact with the electrical pathways of the circuit board means.

* * * * *